United States Patent [19]

Kurata

[11] 4,023,319

[45] May 17, 1977

[54] CURTAIN WALL ASSEMBLY OF INTERFITTING GLASS BLOCKS

[76] Inventor: Takao Kurata, 739-1, Oaza-Gokan, Tsukiyonomachi, Tone, Gunma, Japan

[22] Filed: June 9, 1975

[21] Appl. No.: 584,727

[52] U.S. Cl. ..... 52/308; 52/235; 52/306; 52/311

[51] Int. Cl.[2] ..... E04C 1/42; E04H 1/00

[58] Field of Search ..... 52/235, 477, 240, 308, 52/476, 475, 484, 311, 306; 428/1

[56] References Cited

UNITED STATES PATENTS

| | | | |
|---|---|---|---|
| 1,413,169 | 4/1922 | Lawton | 52/306 |
| 1,667,484 | 4/1928 | Liese | 52/308 |
| 1,729,818 | 10/1929 | Burgess | 52/308 |
| 1,960,160 | 5/1934 | Louša | 52/308 |
| 1,970,414 | 8/1934 | Brown | 52/477 |
| 2,086,185 | 7/1937 | Keaney | 52/306 |
| 2,975,853 | 3/1961 | Friend | 52/306 |
| 3,312,029 | 4/1967 | Blum et al. | 52/311 |
| 3,330,084 | 7/1967 | Russell | 52/484 |
| 3,365,841 | 1/1968 | Barnett | 52/311 |
| D85,320 | 10/1931 | Bowman | 52/306 |

FOREIGN PATENTS OR APPLICATIONS

| | | | |
|---|---|---|---|
| 845,388 | 3/1952 | Germany | 52/306 |
| 914,868 | 1/1963 | United Kingdom | 52/308 |

*Primary Examiner*—Price C. Faw, Jr.
*Assistant Examiner*—Robert C. Farber
*Attorney, Agent, or Firm*—Spensley, Horn & Lubitz

[57] ABSTRACT

A decorative partition or like curtain wall structure is disclosed which can be formed by stacking a number of elementary glass blocks within a generally rectangular supporting frame. Each glass block has at least top and bottom faces contoured correspondingly for interfitting engagement with similar faces of the upper and lower blocks. The opposite lateral faces of each block may also be contoured correspondingly for interengagement with similar lateral faces of the blocks on both sides. Vertical bracing rods can be used to increase the stability of the glass blocks.

5 Claims, 30 Drawing Figures

CURTAIN WALL ASSEMBLY OF INTERFITTING GLASS BLOCKS

BACKGROUND OF THE INVENTION

This invention relates generally to wall structures, and in particular to a decorative, non-bearing or curtain wall structure composed of a number of interfitting glass blocks. The wall structure according to the invention finds typical application in the partitions of buildings and the interior and exterior facings of enclosing walls.

Partitions have been known and used which are constructed from what is generally termed "glass brick" typically taking the form of hollow blocks of translucent glass. Since the conventional glass brick is shaped more or less like the ordinary clay brick, its laying operation requires considerable skill and attention. Moreover, the danger of collapsing is always present during the laying operation. The glass brick is also not fully satisfactory in appearance.

SUMMARY OF THE INVENTION

It is an object of this invention to provide novel elementary glass blocks designed to be stacked in closely interfitting relationship to provide a partition, the interior or exterior facing of an enclosing wall, or like non-bearing wall structure.

Another object of the invention is to provide a wall structure in which the interfitting glass blocks can be laid even by non-professional, semiskilled labor without the possibility of collapsing.

A further object of the invention is to provide a wall structure which is highly appealing aesthetically.

With all these and other objects in view, this invention is directed, in brief, to the provision of a wall structure comprising a generally rectangular supporting frame, and a number of substantially identical glass blocks laid up within the supporting frame. Each glass block includes at least top and bottom faces that are contoured correspondingly for interfitting engagement with similar faces of the overlying and underlying blocks within the supporting frame.

The glass blocks can be either transparent or semi-transparent, colored or uncolored, as desired, to the end that the completed wall structure may be more pleasing in appearance. The blocks can be laid up with or without the use of an adhesive, and vertical bracing rods may be used as necessary for added stability.

The features which are believed to be novel and characteristic of this invention are set forth in particular in the appended claims. The invention itself, however, both as to its general organization and the functions of the various parts, together with the further objects and advantages thereof, will become apparent in the course of the following description of several specific forms of the invention, which is to be read in connection with the accompanying drawings in which like recerence characters refer to like parts throughout the several views.

DETAILED DESCRIPTION

Figure 1:
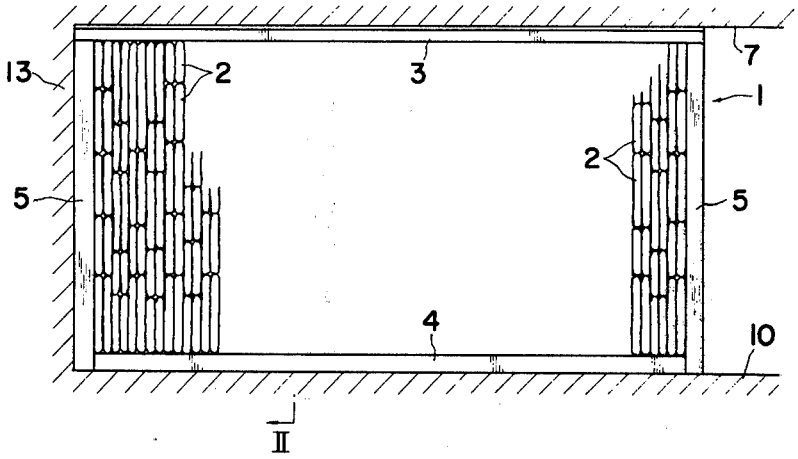
FIG. 1 is a schematic front elevational view of a preferred form of the wall structure according to this invention.

The wall structure according to this invention will now be described more specifically in terms of its first form illustrated in FIGS. 1 to 6. The illustrated wall structure essentially comprises a generally rectangular supporting frame 1 and a number of elementary glass blocks 2 laid up and stacked within the supporting frame in interfitting relationship.

The supporting frame 1 includes a header 3 and sill 4 at the top and bottom and side jambs 5 secured at their ends in any convenient manner to the header and sill. All these constituent members of the supporting frame 1 are U-shaped in cross section and can be made of stainless steel, aluminum, or similar material.

Figure 2:
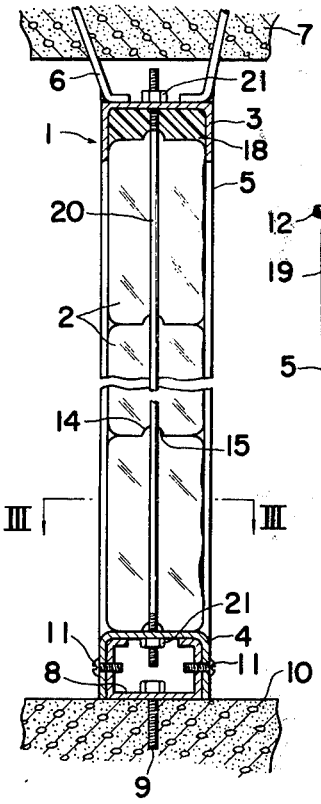
FIG. 2 is an enlarged vertical sectional view, partly broken away, taken substantially along the plane of line II—II in FIG. 1.

As will be seen from a consideration of FIG. 2, the header 3 is supported in position by longitudinally spaced pairs of steel rods 6 which are each welded or otherwise secured at one end to the header and at the other end embedded in a ceiling 7 or like overhead structure. The sill 4 is fitted over a base member 8, also of U-shaped cross section, that is anchored as by bolting 9 to a floor 10. Slotted-headed screws 11 may be used to fasten the sill 4 to the base member 8. At least one of the side jambs 5 may be fastened as by slotted-headed screws 12 (FIG. 4) to an enclosing wall 13 or the like.

Figure 5:
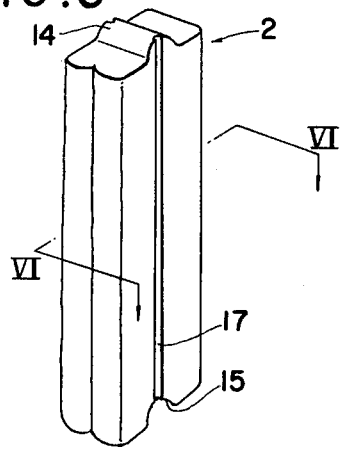
FIG. 5 is an enlarged perspective view of one of the interfitting glass blocks used in the wall structure shown in FIG. 1.
Figure 6:
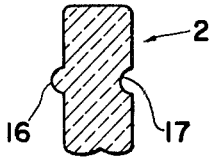
FIG. 6 is a horizontal sectional view taken along the plane of line VI—VI in FIG. 5.

FIGS. 5 and 6 best illustrate the configuration of each glass block 2. This block is solid and has a shape substantially of a right prism and is intended to be installed uprightly within the supporting frame 1. The top face of the block 2 has a rounded projecting rib 14, and its bottom face a groove 15 which is complementary to the rib 14. Furthermore, the block 2 has another rib 16 formed vertically on one of its lateral faces and a complementary groove 17 in the opposite lateral face.

Figure 4:
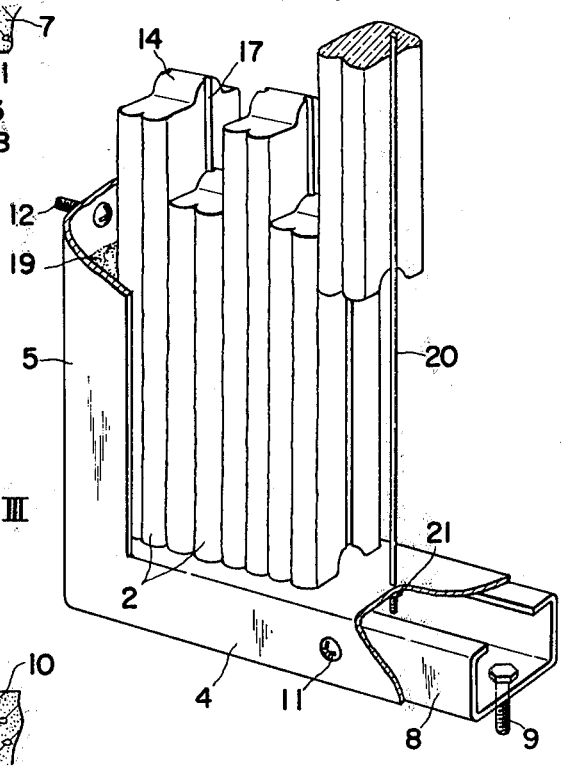
FIG. 4 is an enlarged, fragmentary perspective view of the wall structure shown in FIG. 1.

As best shown in FIG. 4, the glass blocks 2 of the above described general configuration are prepared in two different lengths or heights. In one form of construction the blocks may consist of those each measuring 200 millimeters by 60 by 30 and others each measuring 250 millimeters by 60 by 30.

For assemblage, the taller and shorter glass blocks 2 may first be arranged alternately in upright disposition on the sill 4 of the supporting frame 1 from one of its side jambs 5 to the other, as illustrated in part in FIG. 4. It will be evident from FIG. 3 that the glass blocks thus arranged have their ribs 16 fitted in the grooves 17 of the adjacent blocks to make rib-and-groove joints. Additional blocks may then be laid up upon the bottom row of blocks, with the groove 15 of each additional block fitted over the rib 14 of the underlying block as illustrated in FIG. 2, until they fill the complete space bounded by the supporting frame 1. It should be noted that each of the glass blocks 2 thus stacked within the supporting frame 1 is interfitted in the rib-and-groove fashion with the upper and lower blocks and with those located on both sides.

The taller and shorter glass blocks 2 may be suitably combined in order that the blocks of each column may reach the same height just under the header 3. It is also possible, however, to sever the topmost blocks to a suitable length as required by the distance between header 3 and sill 4. A filler 18 of any suitable material such as synthetic resin may be placed in the spacing between the header 3 and the topmost blocks, as shown in FIG. 2, and a similar filler 19 between each side jamb 5 and the outermost blocks, as in FIGS. 3 and 4.

Figure 3:
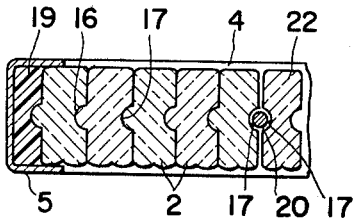
FIG. 3 is a fragmentary horizontal sectional view taken along the plane of line III—III in FIG. 2.

For greater stability of the wall structure the glass blocks 2 can be reinforced with one or more bracing rods 20 of steel or the like extending vertically between header 3 and sill 4, as seen in FIGS. 2, 3 and 4. Each bracing rod 20 is screw threaded at both ends which extend through the header and sill, respectively, and nuts 21 are fitted over these threaded ends of the bracing rod to securely hold same in position. Preferably, one such bracing rod 20 should be arranged every three to five columns of the blocks.

With particular reference to FIG. 3, each bracing rod 20 is intended to fit between the opposed grooves 17 of the two columns of blocks located on both sides. To this end the blocks to be arranged on either side of each bracing rod 20 may each be grooved vertically on both of the opposite lateral faces, as indicated by the numeral 22 in FIG. 3, although the blocks shown in FIGS. 5 and 6 can be used in place of such blocks 22 if their ribs 16 are directed away from the bracing rod.

The stability of the wall structure may, if necessary, be further increased by bonding all the glass blocks to each other by use of an epoxy resin adhesive, among other bonding agents. Such an adhesive may be used whenever necessary in all the succeeding forms of the invention.

To enhance the decorative aspect of the wall structure according to the invention, the glass blocks 2 may be prepared on several matching colors, and the differently colored blocks may be combined in a suitable pattern within the supporting frame. The blocks may also have their exposed faces suitably shaped unevenly, rather than exactly flat, for some extra effects. When this wall structure is used as a decorative interior or exterior facing of an enclosing wall, light sources may be installed at suitable spacings behind the glass blocks 2. This arrangement serves not only to render the blocks far more appealing aesthetically but to effect the indirect illumination of the neighboring space as well.

Another form of the invention shown in FIGS. 7 to 11 also comprises a generally rectangular supporting frame 1, and a number of interfitting glass blocks 2*a* laid up in horizontal disposition within the supporting frame. The supporting frame 1 can be identical to that used in the preceding form except that its sill 4*a* is mounted directly upon the floor 10 and anchored thereto by longitudinally spaced pairs of steel strips or rods 30, as will be evident from FIGS. 8 and 10.

Figure 9:
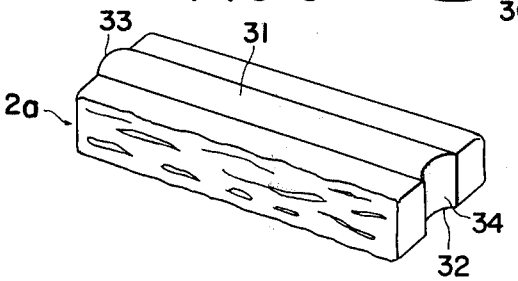
FIG. 9 is an enlarged perspective view of one of the interfitting glass blocks used in the wall structure shown in FIG. 7.
Figure 10:
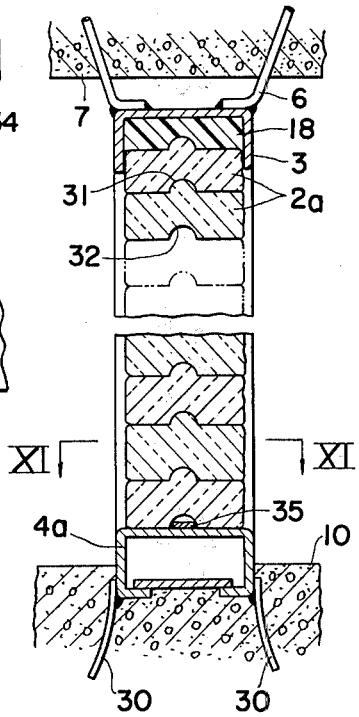
FIG. 10 is an enlarged vertical sectional view, partly broken away, taken substantially along the plane of the line X—X in FIG. 7.
Figure 11:
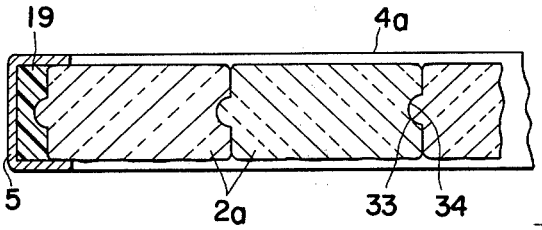
FIG. 11 is a fragmentary horizontal sectional view taken along the plane of line XI—XI in FIG. 10.

As illustrated in FIG. 9, each glass block 2*a* is solid and substantially in the shape of a right prism like the above described block 2. Also like the preceding example the block 2*a* has a rib 31 formed lengthwise on its top face and a corresponding groove 32 in its bottom face. Another rib 33 and corresponding groove 34 are formed on the opposite lateral or end faces of the block 2*a*.

Figure 8:
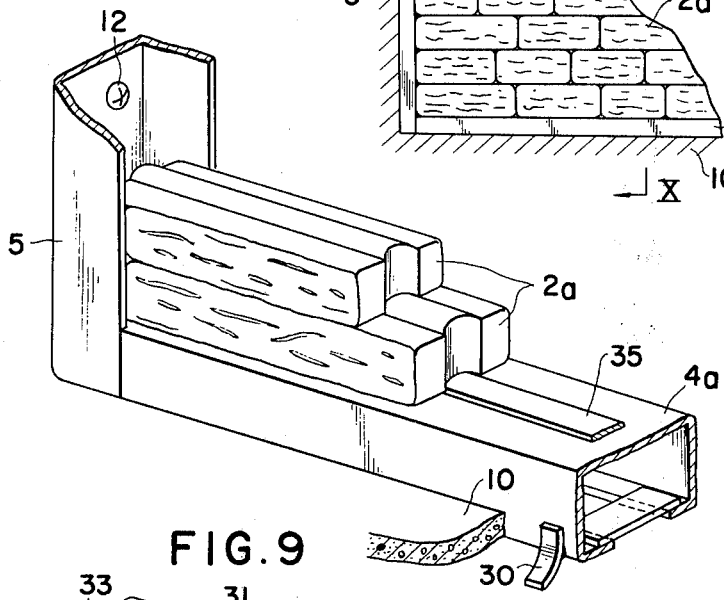
FIG. 8 is an enlarged, fragmentary perspective view of the wall structure shown in FIG. 7.

It will be observed from FIG. 8 that the blocks 2*a* are formed in two different lengths or horizontal dimensions. Since these blocks are designed to be laid in horizontal disposition within the supporting frame 1 as aforesaid, the longer and shorter blocks may be so used that the joint between any two horizontally adjoining blocks will not align with the joints between those located immediately over or under the two blocks.

A positioning strip 35 is fixedly mounted lengthwise on the sill 4*a* so as to be received in the grooves 32 of the bottom row of blocks 2*a*. Additional blocks are laid up on the bottom row of blocks in much the same way as ordinary bricks. As will be apparent from FIGS. 10 and 11, all the blocks 2*a* are interfitted in the rib-and-groove fashion. Other details of construction are identical to those previously set forth in conjunction with FIGS. 1 to 6 except that the bracing rods 20 are usually unnecessary in this second adaptation.

Figure 12:
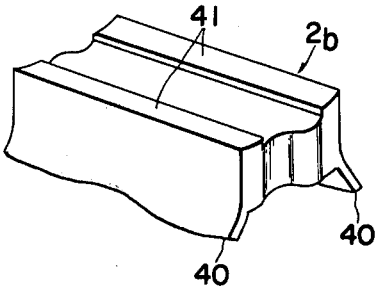
FIG. 12 is a perspective view of a further example of glass block according to the invention.
Figure 13:
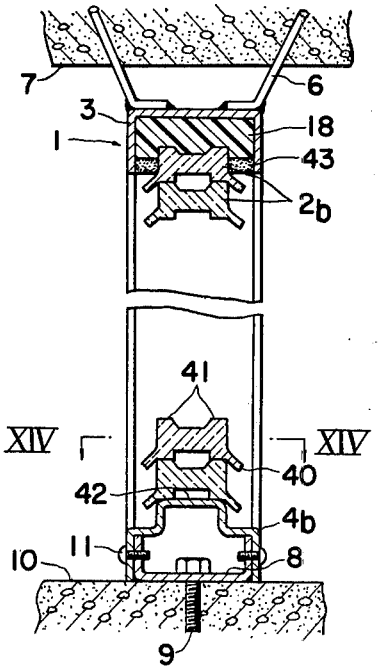
FIG. 13 is a vertical sectional view, partly broken away, of a wall structure incorporating glass blocks of the type shown in FIG. 12.
Figure 14:
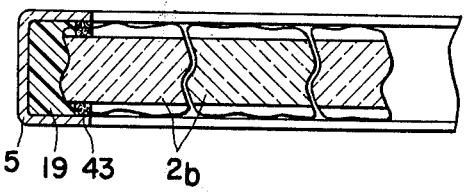
FIG. 14 is a fragmentary horizontal sectional view taken along the plane of line XIV—XIV in FIG. 13.
Figure 7:
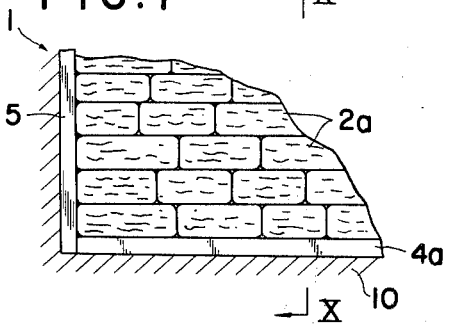
FIG. 7 is a fragmentary front elevational view of another form of the wall structure according to the invention.

Glass blocks 2*b* shown in FIGS. 12 to 14 may be considered a modification of the blocks 2*a* because they are also solid and substantially in the form of a prism and are intended to be laid horizontally in use. The most pronounced feature of the modified block 2*b* resides in a pair of flaring fins 40 formed along the opposed marginal edges of its bottom for decorative purposes. The top face of the block 2*b* is shown to have a pair of parallel space ribs 41 along its longitudinal edges which can be neatly received between the flaring fins 40 of the upper block in use. Both end or lateral faces of the block 2*b* are contoured correspondingly or in a complementary manner in what may be termed a zigzag configuration for interengagement with similar end faces of other blocks.

The supporting frame 1 used in this third form of the invention is identical to that used in the FIGS. 1 to 6 embodiment except that its sill 4*b* is partly raised at 42 to provide a seating for the bottom row of blocks 2*b*. These blocks can be laid up in essentially the same manner as the blocks 2*a*, and the use of the bracing rods 20 is also unnecessary. However, caulking 43 may be applied to the gaps, if any, between the edges of the header 4 and side jambs 5 and the front and rear faces of the blocks 2*b*.

Figure 15:
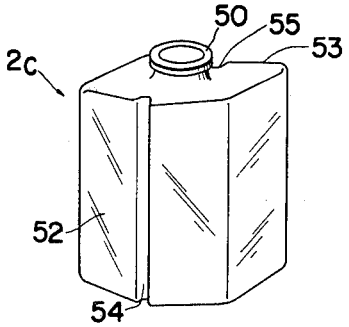
FIG. 15 is a perspective view of a further example of glass block according to the invention.
Figure 16:
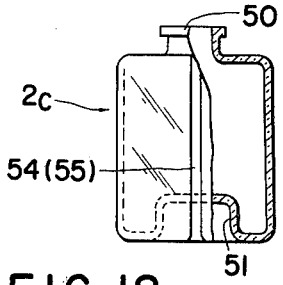
FIG. 16 is a side elevational view, partly broken away, of the glass block shown in FIG. 15.

In still another form of the invention shown in FIGS. 15 to 19, each glass block 2*c* is of substantially bottle-like configuration, being hollow and necked at 50 on its top face, as best seen in FIGS. 15 and 16. The bottom face of this block has a recess 51 which is shaped and sized to fit over the neck 50 of the underlying block in use.

Figure 18:
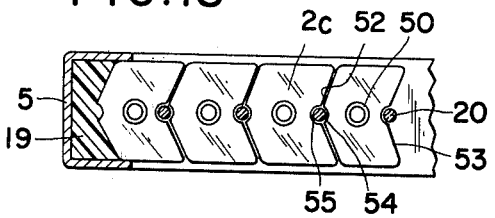
FIG. 18 is a fragmentary horizontal sectional view taken along the plane of line XVIII—XVIII in FIG. 17.
Figure 19:
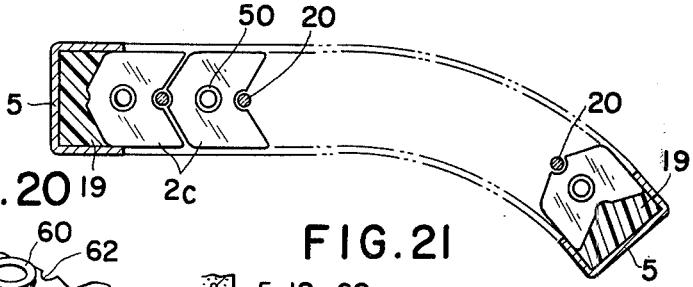
FIG. 19 is a view somewhat similar to FIG. 18 but showing an alternative arrangement of the glass blocks of the type shown in FIGS. 15 and 16.

When seen in a plan view as in FIG. 18 or 19, the block 2*c* is shaped like the feathers or vanes of an arrow, such that its opposite lateral faces are correspondingly shaped into a V-shaped protuberance and indentation 52 and 53, respectively, so as to be interfittable with similar lateral faces of the adjacent blocks. Furthermore, the block 2*c* has a groove 54 of semicircular cross section along the ridge of its V-shaped protuberance 52 and another similar groove 55 along the ridge of its V-shaped indentation 53.

Figure 17:
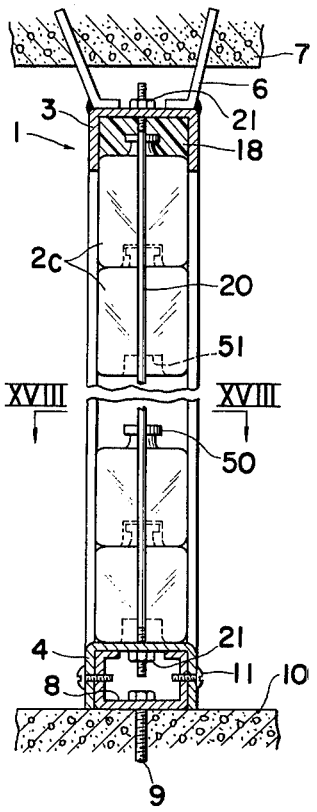
FIG. 17 is a vertical sectional view, partly broken away, of a wall structure incorporating glass blocks of the type shown in FIGS. 15 and 16.

FIGS. 17 and 18 illustrate the manner of laying the glass blocks 2*c* within the supporting frame 1, which is exactly identical to that used in the first form of the invention. The neck 50 of each block 2*c* is fitted in the recess 51 of the overlying block, whereas the V-shaped protuberance 52 of each block is fitted in the corresponding indentation 53 of the block located on one side.

It will be noted from FIG. 18 that the grooves 54 of each column of blocks 2*a* cooperate with the opposed grooves 55 of the adjacent column of blocks to accommodate the bracing rod 20 extending vertically between the header 3 and sill 4 of the supporting frame 1. Notwithstanding the showing of FIG. 18, it is not of absolute necessity to provide the bracing rod between every two adjacent columns of blocks. This is even more so if the blocks 2*c* are formed in two or more different heights and so laid up that the horizontal joint between any two blocks will not align with similar joints between those located on either side.

Advantageously, the glass blocks 2*c* can be so laid as to provide a curved wall or partition, as illustrated in FIG. 19. It is also possible to arrange electric lamps or like light sources within these blocks.

Figure 20:
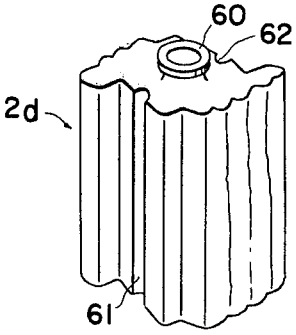
FIG. 20 is a perspective view of a further example of glass block according to the invention.
Figure 21:
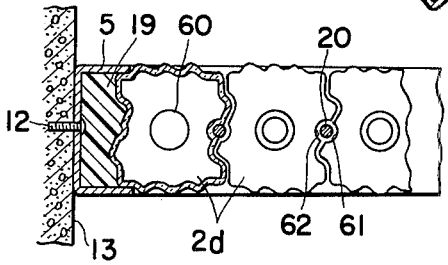
FIG. 21 is a fragmentary horizontal sectional view of a wall structure incorporating glass blocks of the type shown in FIG. 20.

FIGS. 20 and 21 illustrate a slight modification of the preceding adaptation, which features a glass block 2*d* of hollow, substantially prism-shaped configuration. This block also has a neck 60 on its top face and a corresponding recess, not shown, on its bottom face. The opposite lateral faces of the block 2*d* are correspondingly and complementarily shaped in a zigzag fashion for interengagement with similar lateral faces of other blocks. Grooves 61 and 62 of semicircular cross section are formed vertically on the respective lateral faces of the block 2*d* for accommodating the bracing rods 20 in use, as previously explained with particular reference to FIG. 18. The front and rear faces of the block 2*d* are corrugated or scalloped for decorative purposes. Other details of construction will be apparent from the foregoing desription of FIGS. 15 to 18.

Figure 22:
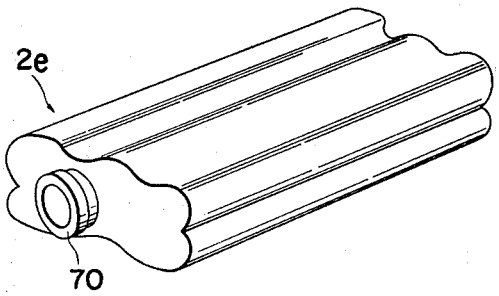
FIG. 22 is a perspective view of a further example of glass block according to the invention.
Figure 23:
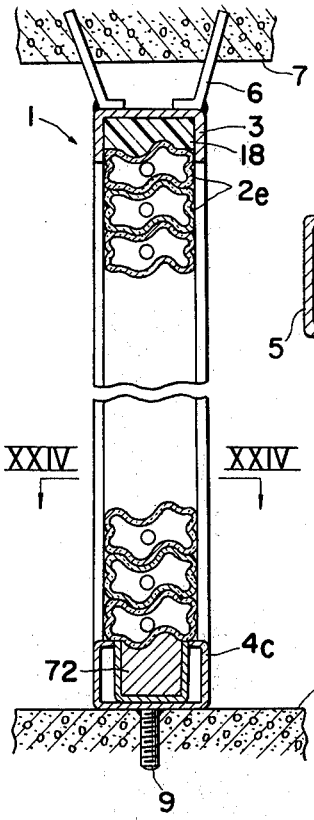
FIG. 23 is a vertical sectional view, partly broken away, of a wall structure incorporating glass blocks of the type shown in FIG. 22.
Figure 24:
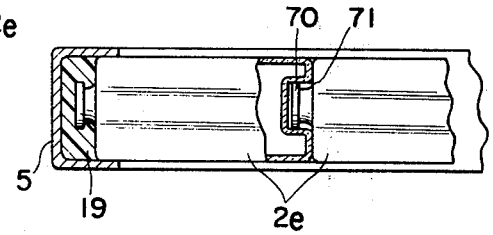
FIG. 24 is a fragmentary horizontal sectional view taken along the plane of line XXIV—XXIV in FIG. 23.

Shown in FIGS. 22 to 24 is a further form of the invention which incorporates horizontally elongated, hollow glass blocks 2*e*. As best shown in FIG. 22, each block 2*e* has its top and bottom faces correspondingly shaped into somewhat irregular corrugations, such that in use the block is closely interfittable with other identical blocks positioned directly thereover or thereunder, as wil be apparent from FIG. 23. A neck 70 projects from one of its lateral or end faces, and a corresponding recess 71 is formed on the opposite lateral face for receiving the neck 70 of the adjacent block, as shown in FIG. 24. The front and rear faces of this block are also shown to be scalloped for decorative purposes.

The supporting frame 1 for use with the glass blocks 2*e* can be substantially identical to the preceding examples. Its sill 4*c*, however, must be grooved longitudinally to receive a support member, as designated 72 in FIG. 23, which support member has a waved upper surface to permit the bottom row of blocks 2*e* to rest evenly thereon. These blocks can also be formed in two or more different lengths or horizontal dimensions and can be laid up within the supporting frame 1 without aid of bracing rods.

Figure 25:
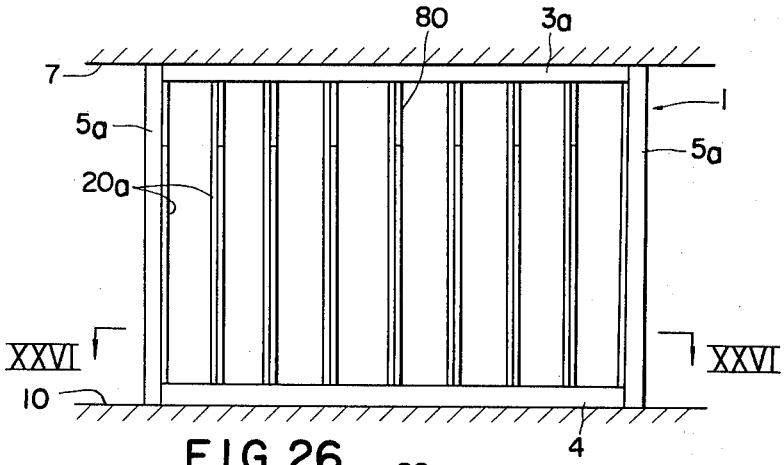
FIG. 25 is a front elevational view of the supporting frame and bracing rods for use in a still further form of the invention.
Figure 26:
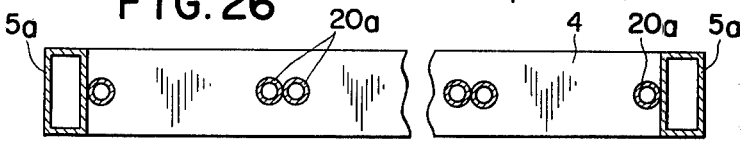
FIG. 26 is an enlarged horizontal sectional view, partly broken away, taken along the plane of line XXVI—XXVI in FIG. 25.
Figure 27:
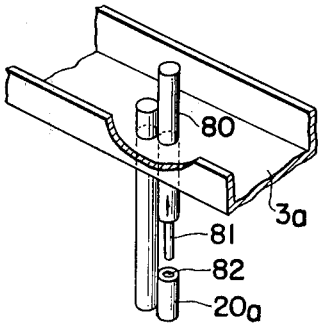
FIG. 27 is an enlarged, fragmentary perspective view explanatory of the way in which one of each paired bracing rods shown in FIGS. 25 and 26 has its top end portion removed for the laying operation of glass blocks.

The wall structure shown in FIGS. 25 to 30 differs from all of the preceding forms of the invention in that its glass blocks 2*f* are specifically designed for combined use with pairs of bracing rods 20*a* which are to be positioned on both sides of the respective columns of the blocks. The supporting frame 1 of this wall structure can be identical to that used, for example, in the first form of the invention except that its side jambs 5*a* each take the shape of a hollow rectangle in cross section, as shown in FIG. 26, and that its header 3*a* has its bottom closed, as shown in FIG. 27.

AS will be seen from FIGS. 25 and 26, each pair of bracing rods 20*a* extending vertically between the header 3*a* and sill 4 of the supporting frame 1 has a constant spacing therebetween to accommodate a single column of the blocks 2*f* in a manner still to be described. No spacing exists between the respective pairs of bracing rods; that is, one of each paired bracing rods is arranged in close contact with the opposite one of the next pair. The two outermost bracing rods are individually arranged in close contact with the respective side jambs *5a*.

It will be noted from FIG. 27 that one of each paired bracing rods 20*a* has a removable top end portion 80. Each removable top end portion 80 has a pin 81 slidable into and out of an axial hollow interior 82 formed in the remainder of the corresponding bracing rod 20*a*. The length of this removable top end portion should be at least equal to the height of each block 2*f*.

Figure 28:
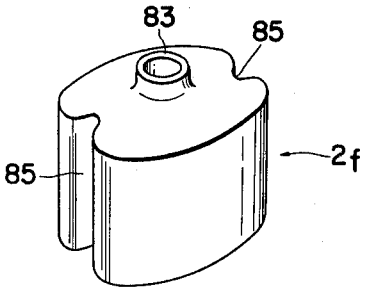
FIG. 28 is a perspective view of a glass block to be laid in the supporting frame shown in FIGS. 25 and 26.

With particular reference to FIG. 28, each glass block 2*f* is of bottle-like configuration, hollow, elliptical in horizontal section, and necked at 83 on its top face. The bottom face of this block has a recess 84 (FIG. 30) that is shaped and sized to fit over the neck 83 of the underlying block in use. The block 2*f* also has a pair of oppositely located, vertical grooves 85 for engaging the respective paired bracing rods 20*a*, as hereinafter explained.

Figure 29:
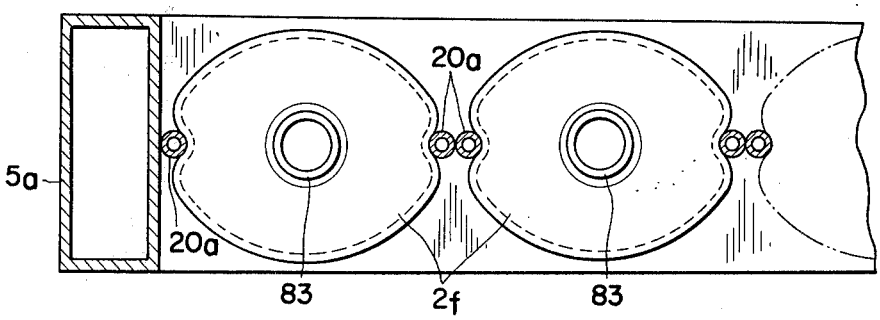
FIG. 29 is a fragmentary horizontal sectional view of the wall structure that has been formed by laying the glass blocks of FIG. 28 in the supporting frame shown in FIGS. 25 and 26.
Figure 30:
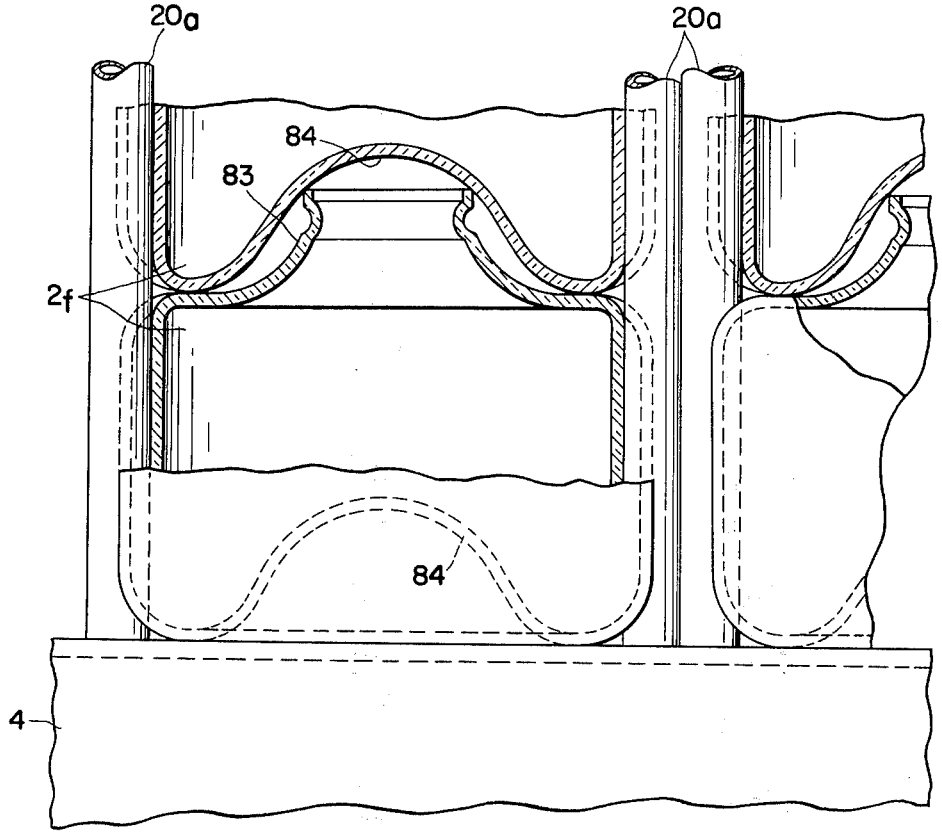
FIG. 30 is an enlarged, fragmentary side elevational view of the wall structure shown in FIG. 29, in which the glass blocks are shown partly broken away to reveal the interfitting relationship therebetween.

For laying the glass blocks 2*f* within the supporting frame 1, the removable top end portion 80 of, for example, the outermost bracing rod 20*a* may first be raised in a manner which will be apparent from a consideration of FIG. 27. The blocks 2*f* can then be successively slid down between this outermost bracing rod and the adjacent rod through the widened spacing that has been formed by raising the top end portion 80. The pair of bracing rods are of course engaged in the respective grooves 85 of the successive blocks, as shown in FIG. 29, and the neck 83 of each block is fitted in the recess 84 of the overlying block, as shown in FIG. 30. After the topmost block has been laid, the top end portion 80 may be re-installed in position by having its pin 81 inserted into the axial hollow 82 of the outermost bracing rod.

The foregoing procedure is repeated to form successive columns of the blocks 2*f* within the supporting frame 1. The blocks 2*f* can also be formed in two or more different heights, and the different sized blocks can be stacked in any combinations calculated to make the wall structure more pleasing in appearance. These blocks are also suitable for housing electric lamps or the like. The use of an adhesive is usually unnecessary in this particular form.

It is believed that the various objects of this invention, either expressly stated or otherwise, have been fully accomplished in the various forms of the wall structure shown and described hereinbefore. It is also understood, however, that the invention itself is not to be restricted by the exact showing of the drawings or the description thereof but is inclusive of many modifications or changes.

What is claimed is:

1. A decorative, non-load-bearing glass wall structure comprising, in combination, a supporting frame, horizontally adjoining pairs of bracing rods supported vertically by said supporting frame, each of the pairs of bracing rods consisting of two horizontally spaced apart rods, each rod of each pair being in close contact with the adjoining rod of the adjoining pair, a plurality of glass blocks laid up between the spaced apart rods of each pair, each of said glass blocks having a pair of vertical side grooves engaging the rods, respectively, one of each pair of the rods having a top end portion which is shiftable upward away from the remaining part of the rod to provide between the rods of each pair of widened horizontal spacing through and from which the glass blocks can be slid down between the rods of the pair during the laying operating of the glass blocks.

2. The glass wall structure as set forth in claim 1 wherein each of said glass blocks has its top and bottom faces contoured correspondingly for interfitting engagement with similar faces of the overlying and underlying glass blocks.

3. The glass wall structure as set forth in claim 1 wherein each of said glass blocks is of a hollow, bottle-like configuration including a neck on its top face and a corresponding recess in its bottom face, said neck of each of said glass blocks being fitted in said recess of the overlying glass block.

4. The glass wall structure as set forth in claim 1 wherein said supporting frame is of a generally rectangular form having an upper horizontal header, a lower horizontal sill, and a pair of side jambs, said header being a beam with its bottom closed.

5. The glass wall structure as set forth in claim 4 wherein said shiftable top end portion of the rod has a downwardly extending pin which is upwardly slidably fitted in the top of the remaining part of the rod, said top end portion being slidably passed through the bottom of the header, whereby the top end portion can be outwardly slid into the header away from the remaining part of the rod, the part of said top end portion below the header being of a vertical length at least equal to the height of each block.

* * * * *